US006659782B2

(12) United States Patent
Wu

(10) Patent No.: US 6,659,782 B2
(45) Date of Patent: Dec. 9, 2003

(54) ELECTRICAL ADAPTER WITH DUAL PLUG STRUCTURE

(75) Inventor: Michael Wu, Hsin Tien (TW)

(73) Assignee: Formosa Electronic Industries Inc., Taipei Hsien (TW)

( * ) Notice: Subject to any disclaimer, the term of this patent is extended or adjusted under 35 U.S.C. 154(b) by 0 days.

(21) Appl. No.: 10/101,415

(22) Filed: Mar. 20, 2002

(65) Prior Publication Data

US 2003/0181082 A1 Sep. 25, 2003

(51) Int. Cl.[7] ..... H01R 13/44
(52) U.S. Cl. ..... 439/131; 439/172
(58) Field of Search ..... 439/131, 171, 439/172, 173, 174, 956, 638

(56) References Cited

U.S. PATENT DOCUMENTS 5,474,464 A * 12/1995 Drewnicki ..... 439/172
5,791,921 A * 8/1998 Lee ..... 439/172
6,126,460 A * 10/2000 Wu ..... 439/131
6,247,941 B1 * 6/2001 Lee et al. ..... 439/105
6,302,717 B1 * 10/2001 Cheung ..... 439/172

* cited by examiner

*Primary Examiner*—Hien Vu
(74) *Attorney, Agent, or Firm*—Rosenberg, Klein & Lee

(57) ABSTRACT

A dual-plug adapter includes a casing defining an interior space. The casing forms a socket having a first and second slots for receiving an external plug. A circuit board is fixed in the interior space and includes first and second conductive members corresponding to the first and second slots of the socket for electrically engaging first and second blades of the external plug. First and second pairs of conductive, resilient leaves are formed on the circuit board and respectively and electrically connected to the first and second members. A plug portion is accommodated in the cavity, including a primary plug movably received in the cavity. The primary plug has first blades for engaging an external socket. The primary plug also has first conductive pads connected to the first blades. The primary plug is movable between a non-operative position and an operative position where the first conductive pads engage the first pair of conductive leaves of the circuit board. The plug portion also includes a secondary plug having second blades for engaging a different external socket. The secondary plug has second conductive pads electrically connected to the second blades. The secondary plug is movable between a non-operative position and an operative position.

4 Claims, 8 Drawing Sheets

ELECTRICAL ADAPTER WITH DUAL PLUG STRUCTURE

BACKGROUND OF THE INVENTION

1. Field of the Invention

The present invention relates generally to an electric adapter, and in particular to an electric adapter having dual plugs for mating different sockets of an electric main.

2. Description of the Prior Art

Chargers for charging electrical appliances having built-in rechargeable batteries are commonly known, such as mobile phones and electric shavers. The chargers have a plug for connection with a wall outlet or a socket of an electric main. However, since the wall outlet or electric socket is of different designs in different areas/countries and since the voltage of the electric main of different areas/countries is different, a charger designed for a particular area is in general not suitable for use in other areas/countries. Chargers or electrical appliances equipped with an electric adapter having two different plugs are available in the market for overcoming the problem. Such an electrical adapter comprises a primary plug having blades arranged for a particular type of electric socket and a secondary plug having blades arranged for another type of electric socket.

The conventional electric adapter comprises only two blades for respectively engaging two receiving slots of the corresponding socket. It is, however, noted that besides the two slots, electric sockets in some areas/countries comprise an additional control slot for conduction of power supplied to the other two slots. If no blade is received in the control slot, power is not allowed to be supplied to the socket. The conventional dual-plug electric adapter is not capable to be used with such a three-slot electric socket.

Some of the electrical appliances are provided with a socket for connection with a plug type connector. Conventionally, an electrical adapter is provided with a socket for connection with an electric appliance. Such a conventional electric adapter does not include a plug for the electric appliances and is thus not suitable for such electric appliances.

It is thus desired to provide an electric adapter for overcoming the above problems.

SUMMARY OF THE INVENTION

An object of the present invention is to provide an electric adapter having two plugs for selectively connecting with sockets of different kinds, an additional blade member being provided for a control slot of a further different type of socket.

Another object of the present invention is to provide an electric adapter having a plug type outlet for connection with an electric appliance to supply power thereto.

To achieve the above objects, in accordance with the present invention, there is provided an electric adapter comprising a casing defining an interior space. The casing forms a socket having at least first and second slots for receiving an external plug. A circuit board is fixed in the interior space and includes first and second conductive members substantially corresponding to the first and second slots of the socket for electrically engaging first and second blades of the external plug. First and second pairs of conductive, resilient leaves are formed on the circuit board and respectively and electrically connected to the first and second members. A plug portion is accommodated in the cavity. The plug portion includes a primary plug movably received in the cavity. The primary plug has first blades for engaging an external socket. The primary plug also has first conductive pads electrically connected to the first blades. The primary plug is movable between a non-operative position and an operative position where the first conductive pads electrically engage the first pair of conductive leaves of the circuit board. The plug portion also includes a secondary plug having second blades for engaging a different external socket. The secondary plug has second conductive pads electrically connected to the second blades. The secondary plug is movable between a non-operative position and an operative position where the second conductive pads engage the second pair of conductive leaves of the circuit board. In addition, a cable is fixed to the circuit board and extends beyond the casing. The cable has a remote end forming a plug type connector for connection with a socket of an electric appliance.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
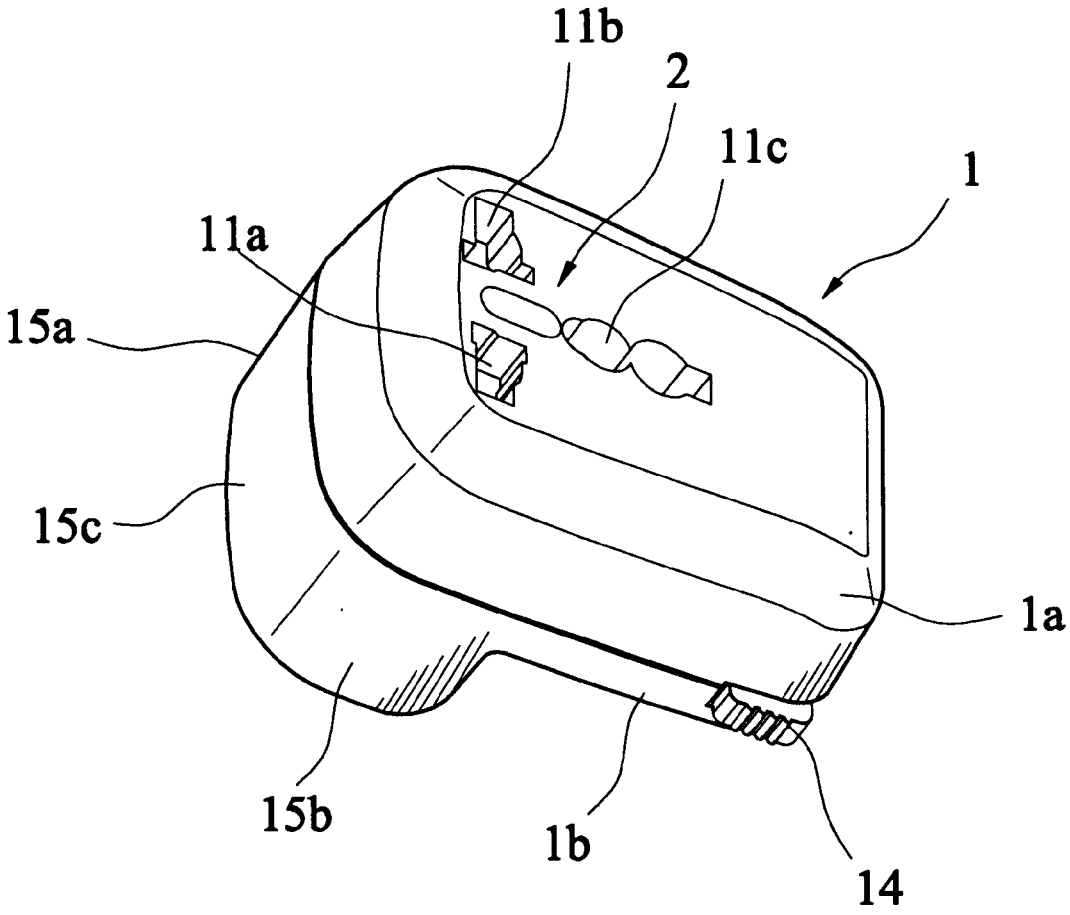
FIG. 1 is a perspective view of a dual-plug electric adapter constructed in accordance with a first embodiment of the present invention.
Figure 2:
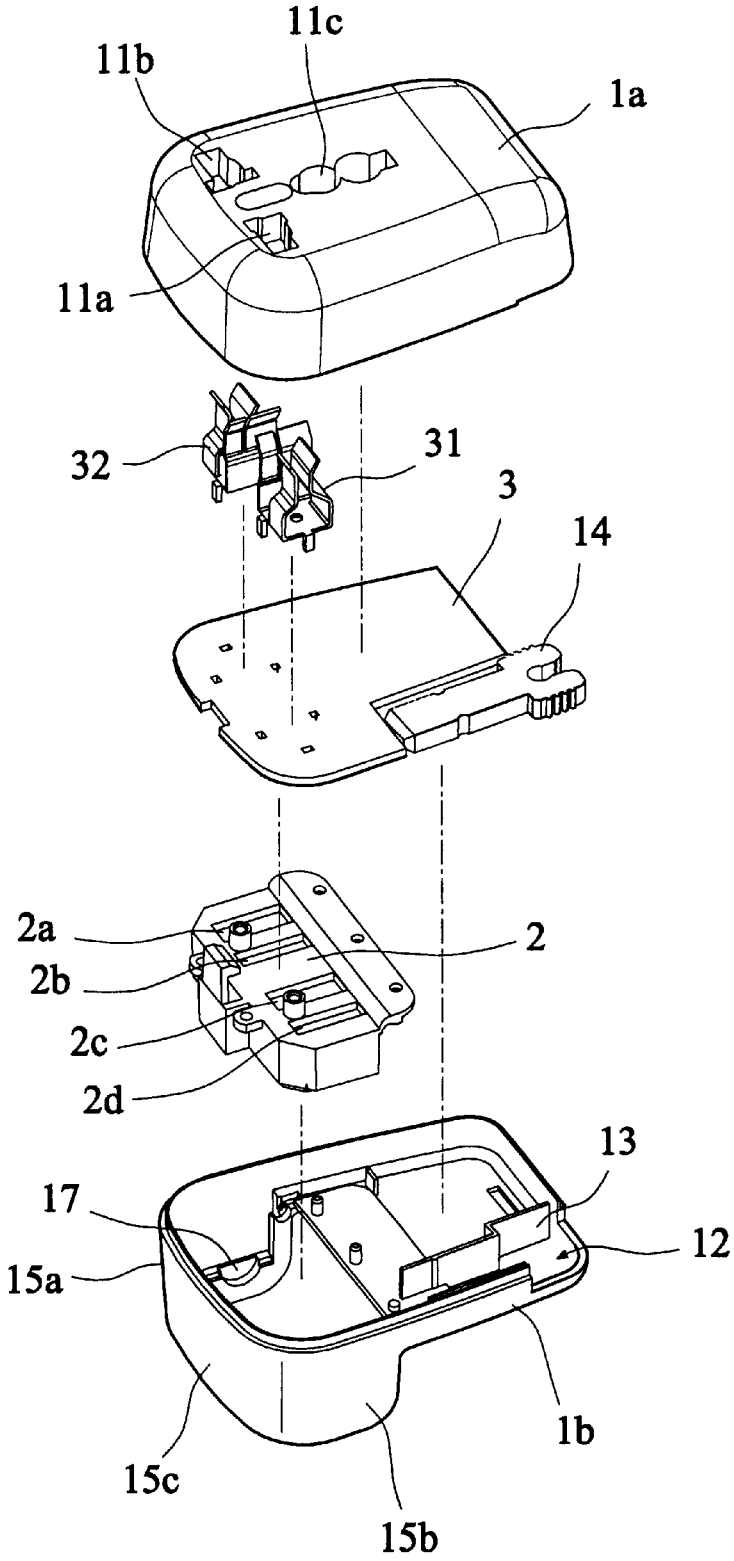
FIG. 2 is an exploded view of the dual-plug electric adapter of the present invention.
Figure 3:
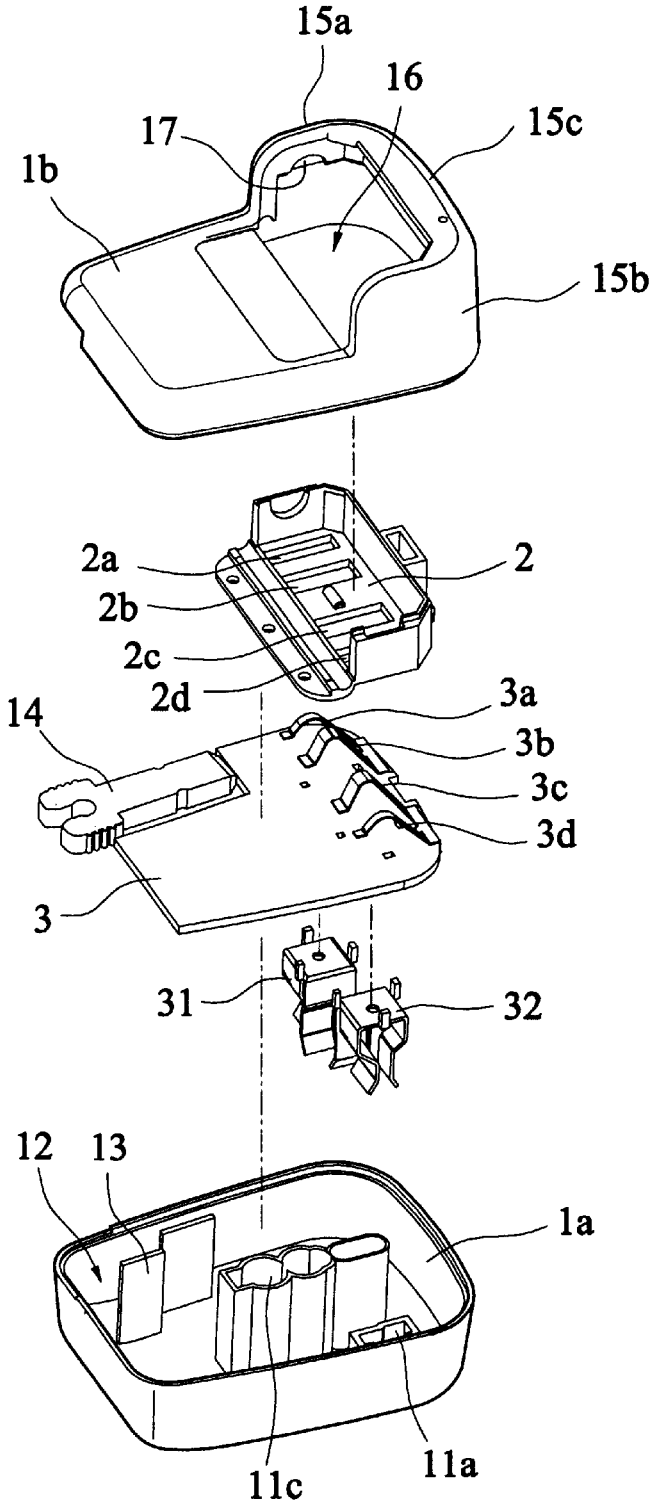
FIG. 3 is another exploded view of the dual-plug electric adapter of the present invention.

With reference to the drawings and in particular to FIGS. 1–7, a dual-plug electric adapter constructed in accordance with a first embodiment of the present invention, generally designated with reference numeral 1, comprises a base portion (shown in FIGS. 1–3 but not labeled) and a plug portion (shown in FIGS. 4–7 but not labeled) movably mounted to the base portion. The base portion comprises a casing (not labeled) constituted by first and second casing members 1*a*, 1*b* mated with each other to define an interior space (not labeled) therein. A socket 11 comprises three slots or holes 11*a*, 11*b*, 11*c*, defined in the first casing member 1*a*, among which slots 11*a*, 11*b* function to receive hot and ground blades of an external plug (not shown), while the slot 11*c* serves to receive a control blade of the external plug, if any.

A partition 13 is formed in the interior space between the casing members 11*a*, 1*b* to define a chamber 12 for accommodating a control blade 14 which is made of an insulative material and sized to be removably inserted into a control slot of a socket of an electric main (not shown) that requires the control blade to actuate the socket for supply of power to the adapter 1 through the plug portion. The control blade 14 is preferably partially projecting out of the casing for manual removal of the control blade 14 out of the casing.

A U-shaped shroud (not labeled) comprising first, second and third wall segments 15*a*, 15*b*, 15*c* is formed on an outside surface (not labeled) of the second casing member 1*b*, defining an opening or cavity 16 that is in communication with the interior space for accommodating the plug portion. A retainer 2 is arranged inside the casing and forms opposite pivot holes 17 with the first and second wall segments 15*a*, 15. The pivot holes 17 will be further discussed.

Four slots 2*a*, 2*b*, 2*c*, 2*d* are defined in the retainer 2 and are substantially parallel to each other. A circuit board 3 is fixed in the interior space of the casing and attached to the retainer 2 in any suitable manner. First and second pairs of resilient leaves (3*a*, 3*d*) and (3*b*, 3*c*) made of conductive materials, are formed on a first surface of the circuit board 3 in such a way that the second pair of resilient leaves 3*b*, 3*c* is located between the resilient leaves 3*a*, 3*d* of the first pair. The resilient leaves 3*a*, 3*b*, 3*c*, 3*d* are all in a convex form for compression toward the circuit board 3 and are partially projecting into the slots 2*a*, 2*b*, 2*c*, 2*d* of the retainer 2.

Two blade engaging members 31, 32 made of conductive materials are formed on a second surface of the circuit board 3. The first member 31 is electrically connected to the resilient leaves 3*a*, 3*b* via conductor patterning of the circuit board 3, while the second member 32 is electrically connected to the resilient leaves 3*c*, 3*d*. The blade engaging members 31, 32 are arranged to be aligned with the slots 11*a*, 11*b* of the socket 11 of the adapter 1 for receiving and forming electric engagement with blades of the external plug.

Figure 4:
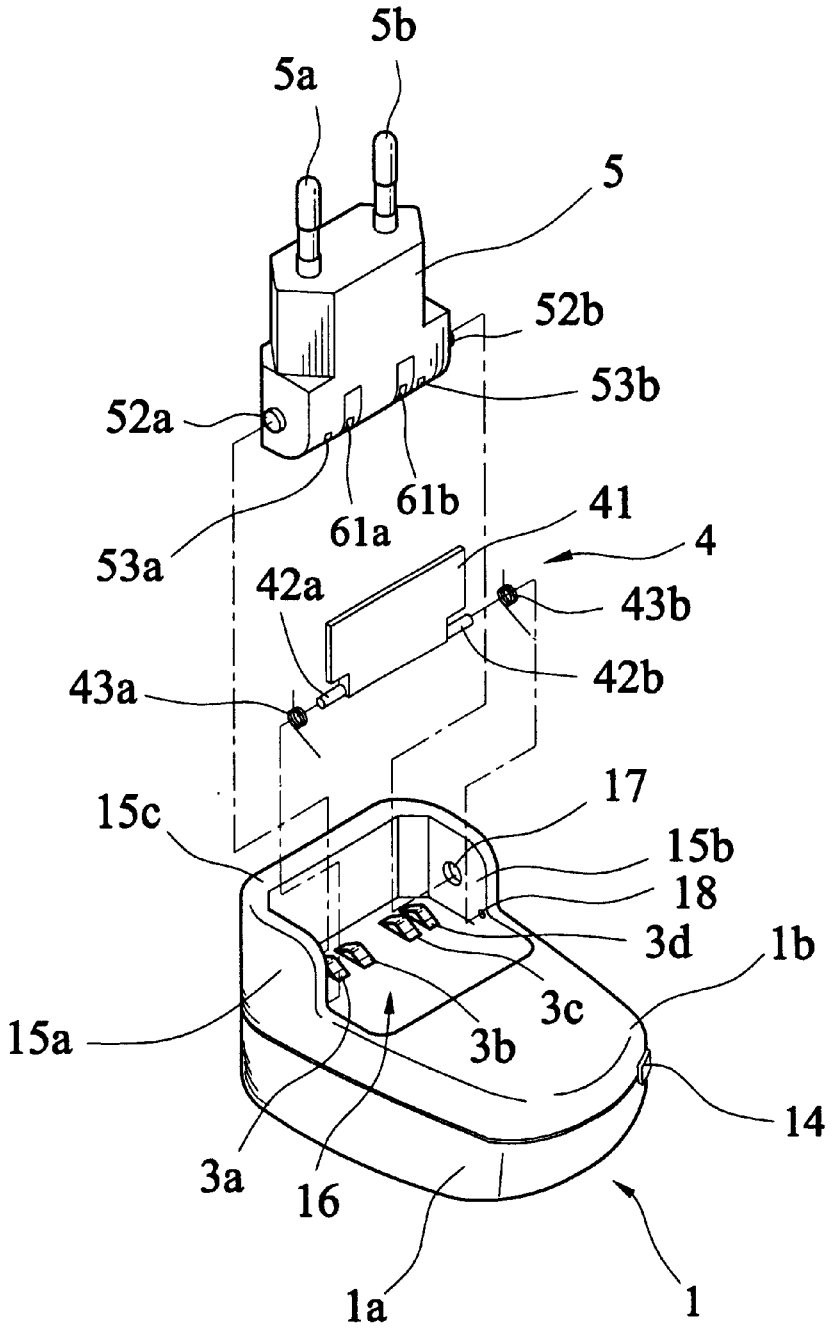
FIG. 4 is an exploded view of the dual-plug electric adapter of the present invention with a plug portion separated from a base portion thereof.
Figure 5:
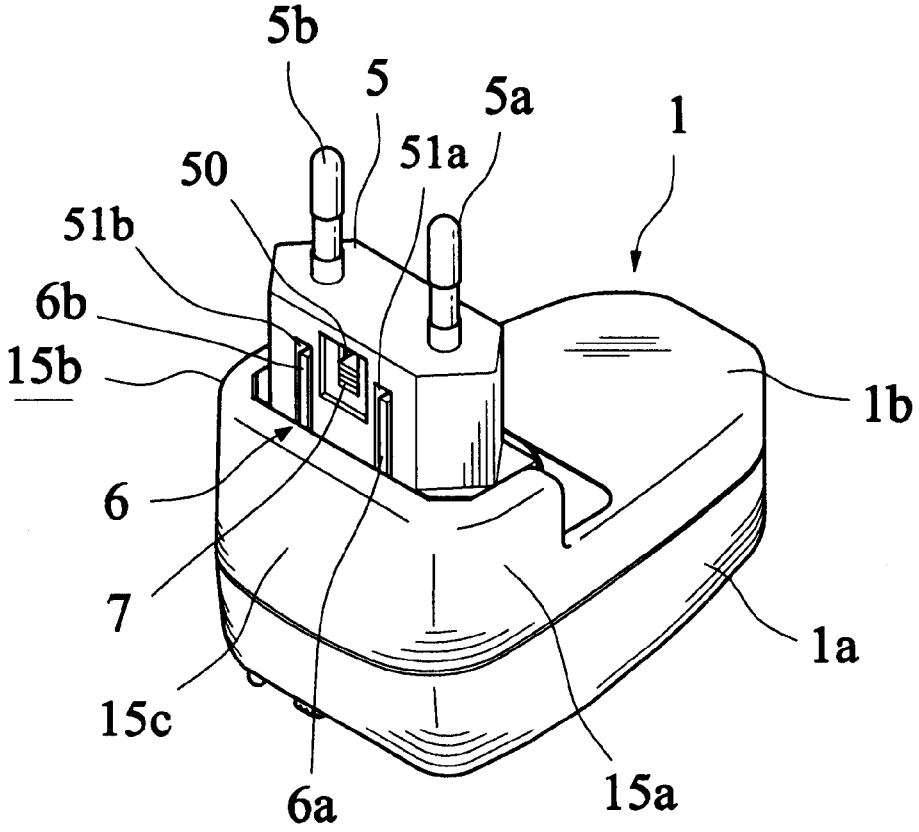
FIG. 5 is a perspective view of the dual-plug electric adapter of the present invention with a primary plug in an operative condition.

As shown in FIGS. 4–7, the plug portion that is accommodated in the cavity 16 of the base portion comprises a primary plug 5 and a secondary plug 6. The primary plug 5 comprises an insulative base (not labeled) forming aligned pivots 52*a*, 52*b* on opposite sides thereof. The pivots 52*a*, 52*b* are rotatably received in the pivot holes 17 defined in the second casing member 1*b* of the base portion whereby the primary plug 5 is movable between a non-operative position (shown in FIGS. 6 and 7) and an operative position (FIGS. 4 and 5). Two blades 5*a*, 5*b* of a first configuration are formed on a front end of the insulative base of the primary plug 5 and extending frontward therefrom.

Figure 6:
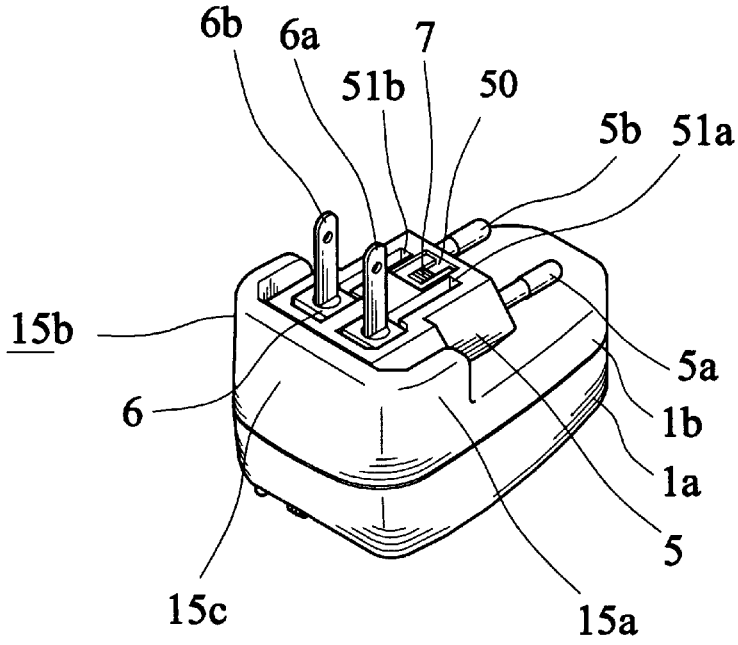
FIG. 6 is a perspective view of the dual-plug electric adapter of the present invention with a secondary plug in an operative condition.
Figure 7:
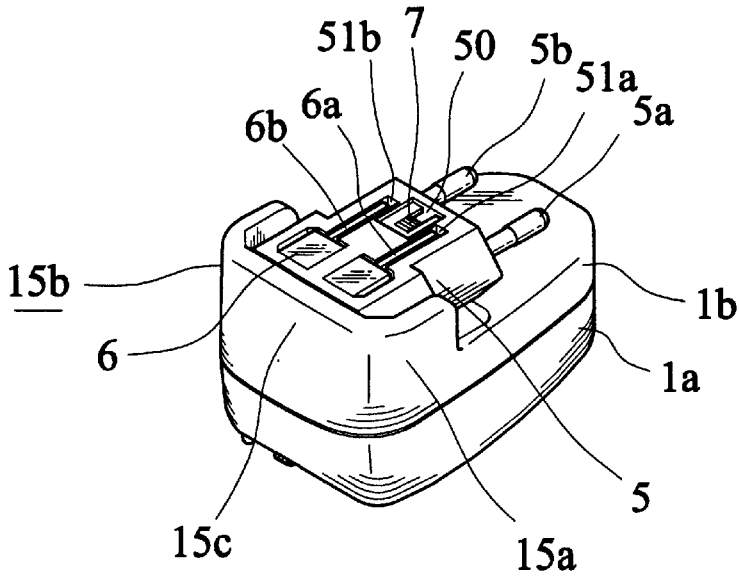
FIG. 7 is another perspective view of the dual-plug electric adapter showing the adapter in a non-operative condition.

The insulative base of the primary plug 5 defines two slots 51*a*, 51*b* in which blades 6*a*, 6*b* of the secondary plug 6 is movably received. A third slot 50 is defined in the insulative base of the primary plug 5 between the slots 51*a*, 51*b* for movably accommodating a control knob 7 which is manually movable between first and second positions to move the blades 6*a*, 6*b* of the secondary plug 6 between a non-operative position as shown in FIG. 7 and an operative position as shown in FIG. 6. The blades 6*a*, 6*b* are of a configuration different from that of the blades 5*a*, 5*b* of the primary plug 5 whereby the plugs 5 and 6 are respectively suitable for different sockets of electric main, such as socket of 110 volts (the secondary plug 6) and 220 volts (the primary plug 5).

The blades 5*a*, 5*b* of the primary plug 5 are electrically connected to conductive pads 53*a*, 53*b* formed on a rear end of the insulative base of the primary plug 5, substantially opposite to the blades 5*a*, 5*b*. The conductive pads 53*a*, 53*b* are arranged so that when the primary plug 5 is in the operative condition, the conductive pads 53, 54 engage the leaves 3*a*, 3*d* of the circuit board 3 whereby when the blades 5*a*, 5*b* mate a socket of an electric main, power is transmitted from the blades 5*a*, 5*b*, through the circuit board 3 to the blade receiving members 31, 32 from which the power is transmitted to an external plug engaging the socket 11 of the adapter 1. If necessary, the control blade 14 can be removed from the casing and inserted into the control slot of the socket.

The blades 6*a*, 6*b* of the secondary plug 6 are electrically connected to conductive pads 61*a*. 61*b* mounted in the insulative base of the primary plug 5. The conductive pads 61*a*. 61*b* engage the resilient leaves 3*b*, 3*c* when the secondary plug 6 is in the operative condition. Thus, when the blades 6*a*, 6*b* mate a socket of an electric main, power is transmitted from the blades 6*a*, 6*b*, through the circuit board 3 to the blade engaging members 31, 32 from which the power is transmitted to an external plug engaging the socket 11 of the adapter 1.

A shock protection board 4 is arranged between the plug portion and the base portion for the protection of a user from electric shock by accidentally contacting the conductive pads 53*a*, 53*b*, 61*a*, 61*b*. The board 4 forms two opposite pivot pins 42*a*, 42*b* on opposite sides thereof for rotatable engagement with apertures 18 defined in first and second wall segments 15*a*, 15*b*. Biasing members, such as rotational springs 43*a*, 43 fit over the pivot pins 42*a*, 42*b*, bias the board 4 to shield the conductive pads 53*a*, 53*b*, 61*a*, 61*b* when the primary plug 5 is moved to the operative position. When the primary plug 5 is moved to the non-operative position, the board is forced to move toward the base portion of the adapter 1 and is interposed between the primary plug 5 and the second casing member 1*b* of the base portion.

Figure 8:
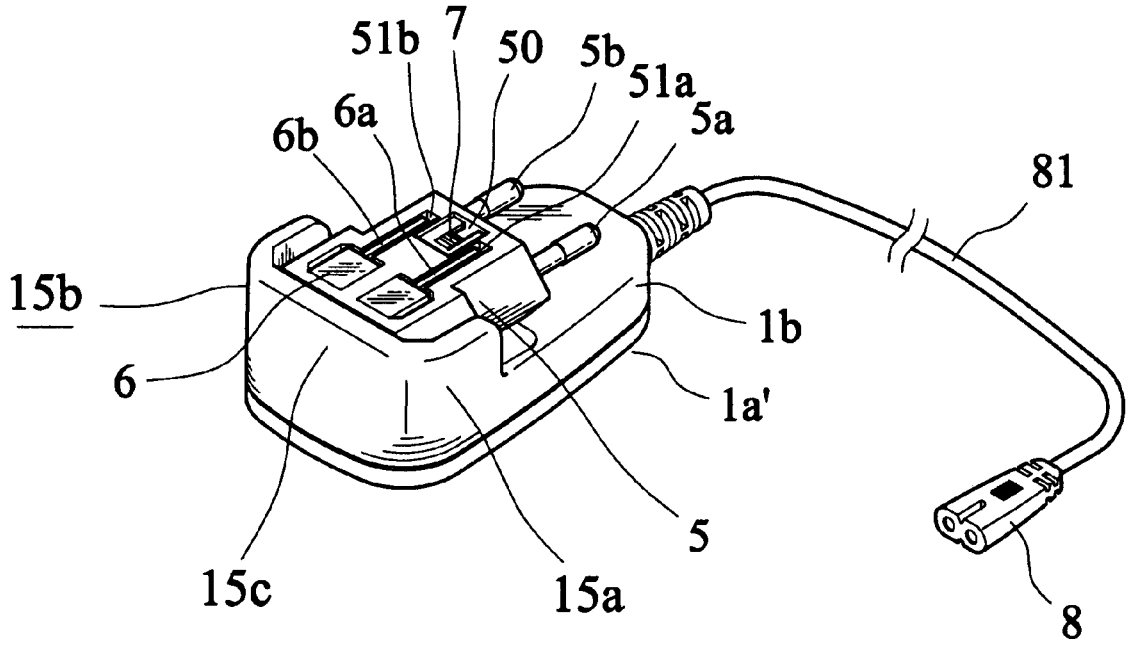
FIG. 8 is a perspective view of a dual-plug electric adapter constructed in accordance with a second embodiment of the present invention wherein a plug type outlet is formed for connection with a socket of an external appliance to supply power thereto.
Figure 9:
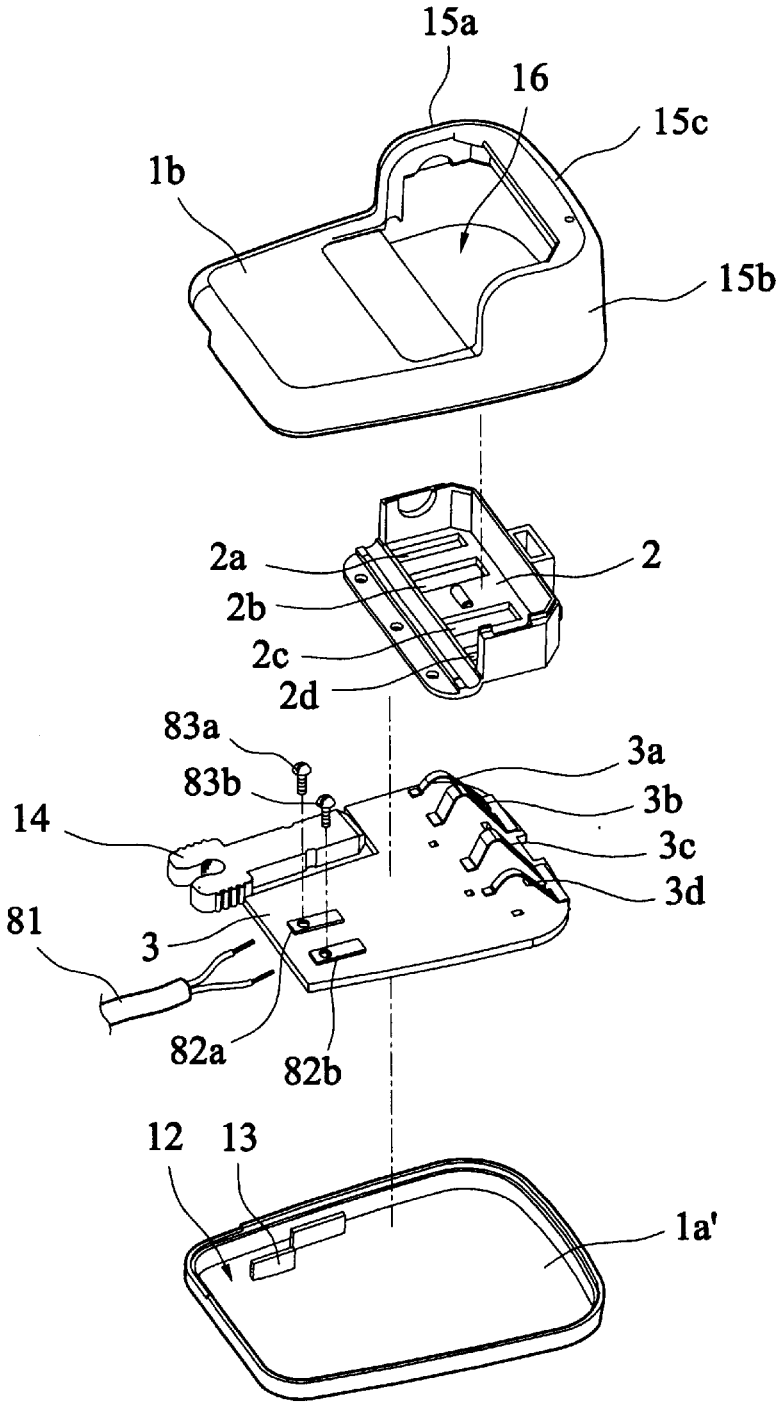
FIG. 9 is an exploded view of the dual-plug electric adapter of the second embodiment of the present invention.

FIGS. 8 and 9 show a second embodiment of the electric adapter in accordance with the present invention. To simplify the description, identical parts of the electric adapter of the second embodiment bear the same reference numerals of the first embodiment and the description thereof is omitted. The electric adapter of the second embodiment comprises a plug portion movably mounted to a base portion. The base portion comprises a casing constituted by first and second casing members 1*a*', 1*b*. The first casing member 1*a*' of the electric adapter of the second embodiment does not form the socket for the external plug. Instead, an electric cable 81 having inner ends fixed to conductive pads 82*a*, 82*b* formed on the circuit board 3 by any suitable means, such as bolts 83*a*, 83*b*, extends beyond the casing of the base portion and forms a plug 8 on an outer, remote end of the cable 81. The plug 8 can engage with a socket formed in an electric appliance, such as a notebook computer or a personal digital assistant (not shown) for supply of power thereto.

The conductive pad 82*a* is electrically connected to the resilient leaves 3*a*, 3*b* of the circuit board 3 via conductor patterning of the circuit board 3, while the conductive pad 82*b* is electrically connected to the resilient leaves 3*c*, 3*d* of the circuit board 3. Thus, when either one of the primary and secondary plugs 5, 6 is connected to an external socket of an electric main, power is supplied through the plug 5 or 6 and the circuit boar 3 to the conductive pads 82*a*, 82*b* from which the power is supplied to the electric appliance connected to the plug 8.

It is noted that although no socket is formed in the first casing members 1*a*' of the electric adapter of the second embodiment, it is apparent to those having ordinary skills to additionally form the socket 11 on the first casing member 1*a*' of the second embodiment to provide additional electricity outlets of the electric adapter 1 of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A dual-plug electric adapter comprising:

a base portion including:

a casing defining an interior space, a cavity being defined in the casing and in communication with the interior space, a socket having first and second slots defined in the casing and adapted to receive first and second blades of an external plug, and a circuit board arranged in the interior space of the casing, first and second blade-engaging members made of conductive materials being mounted on the circuit board and substantially corresponding to the first and second slots of the socket of the casing for electrically engaging the first and second blades of the external plug, first and second pairs of conductive, resilient leaves formed on the circuit board and respectively electrically connected to the first and second blade-engaging members;

a plug portion including:

a primary plug movably received in the cavity and having first blades of a first configuration adapted to engage an external electric socket of a first kind, the primary plug having first conductive pads electrically connected to the first blades, wherein the primary plug is movable between a non-operative position and an operative position where the first conductive pads electrically engage the first pair of conductive leaves of the circuit board, and a secondary plug having second blades of a second configuration adapted to engage an external electric socket of a second kind, the secondary plug having second conductive pads electrically connected to the second blades, wherein the secondary plug is movable between a non-operative position and an operative position where the second conductive pads engage the second pair of conductive leaves of the circuit board; and, a retainer fixed in the cavity, the retainer defining pivot holes for rotatably receiving pivots extending from opposite sides of the primary plug for rotatably supporting the primary plug in the cavity the retainer further defining four slots respectively and partially receiving the resilient leaves therein.

2. The dual-plug electric adapter as claimed in claim 1, wherein the socket of the base portion further comprises a third slot for receiving a third, blade of the external plug.

3. The dual-plug electric adapter as claimed in claim 1, wherein the casing has a chamber defined therein to accommodate selective insertion of a control blade through a corresponding opening in the casing.

4. The dual-plug electric adapter as claimed in claim 1, wherein a shroud is formed on the casing to further define the cavity, the shroud comprising first, second and third wall segments partially surrounding the cavity for accommodating the plug portion.

* * * * *